US011249436B2

(12) United States Patent
Hashimoto

(10) Patent No.: US 11,249,436 B2
(45) Date of Patent: Feb. 15, 2022

(54) APPARATUS BODY AND IMAGE FORMING APPARATUS

(71) Applicant: Haruo Hashimoto, Kanagawa (JP)

(72) Inventor: Haruo Hashimoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/332,396

(22) Filed: May 27, 2021

(65) Prior Publication Data

US 2021/0389715 A1 Dec. 16, 2021

(30) Foreign Application Priority Data

Jun. 10, 2020 (JP) ..... JP2020-100879

(51) Int. Cl.
*G03G 15/00* (2006.01)
*G03G 21/16* (2006.01)

(52) U.S. Cl.
CPC ..... *G03G 21/1623* (2013.01)

(58) Field of Classification Search
CPC ..... G03G 21/1623; G03G 21/1638
USPC ..... 399/110, 124
See application file for complete search history.

(56) References Cited

U.S. PATENT DOCUMENTS 5,991,569 A 11/1999 Sugihara et al.
9,163,429 B2 * 10/2015 Takenaka et al. . G03G 21/1647
10,289,059 B2 * 5/2019 Soda et al. ..... G03G 21/1623
2010/0067942 A1 3/2010 Hagiwara et al.
2010/0239307 A1 9/2010 Onuma et al.
2011/0182614 A1 7/2011 Onuma et al.
2013/0243445 A1 9/2013 Takahira et al.
2013/0266340 A1 10/2013 Hashimoto et al.
2016/0221770 A1 8/2016 Ishii et al.

FOREIGN PATENT DOCUMENTS

JP 11-038753 2/1999
JP 2016-145955 8/2016
JP 2017-226194 12/2017

* cited by examiner

*Primary Examiner* — William J Royer
(74) *Attorney, Agent, or Firm* — Harness, Dickey & Pierce, P.L.C.

(57) ABSTRACT

An apparatus body includes a housing, a drawer, a push-out mechanism, and a positioner. The drawer is attachable to and detachable from the housing. The push-out mechanism pushes out the drawer by a predetermined amount from a setting position at which the drawer is positioned in the housing. The positioner positions the drawer at the setting position in the housing. The positioner includes a fitting hole disposed in one of the housing and the drawer and a positioning pin disposed in the other of the housing and the drawer. The positioning pin positions the drawer at the setting position in the housing in response to fitting of the positioning pin into the fitting hole. The positioning pin and the fitting hole each have a form that releases the fitting in response to pushing out of the drawer by the predetermined amount from the setting position.

6 Claims, 5 Drawing Sheets

APPARATUS BODY AND IMAGE FORMING APPARATUS

CROSS-REFERENCE TO RELATED APPLICATION

This patent application is based on and claims priority pursuant to 35 U.S.C. § 119(a) to Japanese Patent Application No. 2020-100879, filed on Jun. 10, 2020, in the Japan Patent Office, the entire disclosure of which is incorporated by reference herein.

BACKGROUND

Technical Field

Embodiments of the present disclosure generally relate to an apparatus body and an image forming apparatus incorporating the apparatus body.

Related Art

There is an apparatus body including a drawer disposed to be attachable and detachable. The apparatus body and the drawer include a positioner to position the drawer on the apparatus body when the drawer is attached to the apparatus body. The positioner generally includes a positioning pin disposed on one of the apparatus body and the drawer and a positioning hole disposed on the other one of the apparatus body and the drawer, and the positioning pin is fitted to the positioning hole to position the drawer on the apparatus body.

In order to reduce an operation force to draw the drawer from the apparatus body, an apparatus including the positioner includes, for example, a lock disposed on one of the apparatus body and the drawer, a locked wall disposed on the other one of the apparatus body and the drawer on which the lock is hooked at a lock position, and a push-out wall contacting the lock and pushing out the drawer in a direction to pull out the drawer in response to a rotation of the lock in a lock release direction.

SUMMARY

This specification describes an improved apparatus body that includes a housing, a drawer, a push-out mechanism, and a positioner. The drawer is attachable to and detachable from the housing. The push-out mechanism pushes out the drawer by a predetermined amount from a setting position at which the drawer is positioned in the housing. The positioner positions the drawer at the setting position in the housing. The positioner includes a fitting hole disposed in one of the housing and the drawer and a positioning pin disposed in the other of the housing and the drawer. The positioning pin positions the drawer at the setting position in the housing in response to fitting of the positioning pin into the fitting hole. The positioning pin and the fitting hole each have a form that releases the fitting in response to pushing out of the drawer by the predetermined amount from the setting position.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
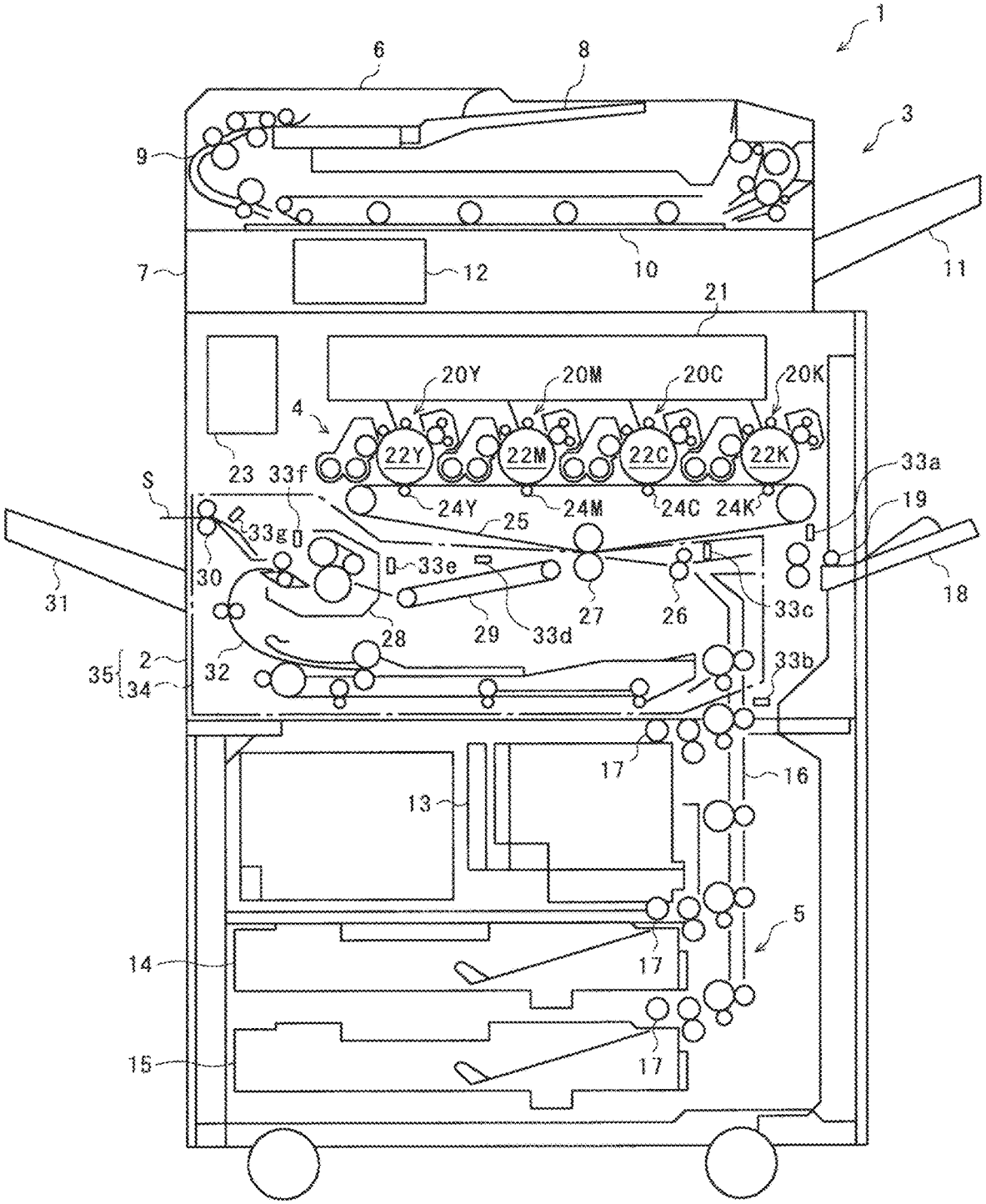
FIG. 1 is a schematic view of a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise.

FIG. 1 is a schematic view illustrating a configuration of an image forming apparatus according to an embodiment of the present disclosure. In FIG. 1, an image forming apparatus 1 is a multifunction peripheral having a printer function and a copying function and includes a housing 2, a document reading unit 3, an image forming section 4, and a sheet feeder 5.

The document reading unit 3 includes a document conveyance device 6 and a scanner 7. Conveyance rollers of the document conveyance device 6 convey a document disposed on a document tray 8 along a document conveyance path 9, and the conveyed document is ejected to a document ejection tray 11 via a platen 10 (an exposure glass). The scanner 7 includes an image reader 12 that is disposed under the platen 10 and reads an image of a document conveyed on the platen 10 to generate image data. The generated image data is sent to the image forming section 4.

The sheet feeder 5 includes a plurality of sheet feeding trays 13, 14, and 15 that store sheets S as recording media and a sheet conveyance path 16 through which the sheet S fed from one of the sheet feeding trays 13, 14, and 15. The plurality of sheet feeding trays 13, 14, and 15 store sheets S of different sizes, respectively. A feed roller 17 separates one sheet from the sheets S stored on the one of sheet feeding trays 13, 14, and 15 and conveys the one sheet to the sheet conveyance path 16. The one sheet is conveyed to the image forming section 4 via the sheet conveyance path 16.

On the right side of the housing 2 in FIG. 1, a manual sheet feeding tray 18 is disposed so as to protrude from a side wall. A feed roller 19 separates one sheet from the sheets S placed on the manual sheet feeding tray 18 and feeds and sends the one sheet to the image forming section 4.

The image forming section 4 uses toners of four colors of yellow (Y), magenta (M), cyan (C), and black (K) to form a full-color image. The image forming section 4 includes four color image forming units 20Y, 20M, 20C, and 20K and an optical writing device 21, and the image forming units 20Y, 20M, 20C, and 20K are horizontally arranged and form a tandem structure. The image forming units 20Y, 20M, 20C, and 20K include photoconductor drums 22Y, 22M, 22C, and 22K as image bearers that rotate counterclockwise in FIG. 1, respectively. The optical writing device 21 irradiates and scans circumferential surfaces of the photoconductor drums 22Y, 22M, 22C, and 22K with light to form electrostatic latent images for yellow, magenta, cyan and black images on the photoconductor drums 22Y, 22M, 22C, and 22K, respectively. A developing device disposed in each of the image forming units 20Y, 20M, 20C, and 20K accommodates color toner that is different in each image forming unit 20Y, 20M, 20C, and 20K and develops the electrostatic latent image for each color to form each color toner image on each of the circumferential surfaces of photoconductor drums 22Y, 22M, 22C, and 22K.

The image forming section 4 includes a controller 23 that controls the operation of each component in the image forming apparatus 1. The controller 23 receives image data transmitted from the document reading unit 3, image data generated by an external computer or the like and transmitted from the external computer, or the like. Based on the image data, the controller 23 controls the optical writing device 21 to irradiate and scan the circumferential surfaces of the photoconductor drums 22Y, 22M, 22C, and 22K with light and controls each of the image forming units 20Y, 20M, 20C, and 20K to form the toner images. In addition, the controller 23 controls various operations in the image forming apparatus 1.

The image forming section 4 further includes primary transfer rollers 24Y, 24M, 24C, and 24K, an intermediate transfer belt 25, a registration roller pair 26, a secondary transfer roller 27, and a fixing device 28. A driver drives and rotates the intermediate transfer belt 25 clockwise in FIG. 1. During a rotation of the intermediate transfer belt 25, the primary transfer rollers 24Y, 24M, 24C, and 24K transfer and superimpose the toner images formed on the photoconductor drums 22Y, 22M, 22C, and 22K onto the intermediate transfer belt 25 to form a full-color toner image on the intermediate transfer belt 25.

On the other hand, the sheet S is fed from the sheet feeder 5 toward the image forming section 4. The registration roller pair 26 temporarily stops the sheet S fed from the sheet feeding tray 13, 14, or 15 or the manual sheet feeding tray 18 to correct a skew of the sheet. Rotating the registration roller pair 26 at a predetermined timing conveys the sheet S to the secondary transfer roller 27, and the secondary transfer roller 27 brings the sheet S into contact with the intermediate transfer belt 25 to secondarily transfer the full-color toner image onto the sheet S.

A conveyance belt 29 conveys the sheet S to which the full-color toner image has been transferred to the fixing device 28. In the fixing device 28, heat and pressure fix the transferred full-color toner image on the sheet S. After the full-color toner image is fixed, an output roller pair 30 ejects the sheet S to the outside of the housing 2 to stack the sheet S on an output tray 31.

The image forming apparatus 1 can form the image on one side of the sheet S and both sides of the sheet S. Whether to perform single-sided image formation or double-sided image formation is determined based on a setting operation of a user or setting data from an external device. When the single-sided image formation is set, the series of operations described above attains the single-sided image formation.

When the double-sided image formation is set, the sheet S passing through the fixing device 28 after the toner image is formed on the one side of the sheet S is conveyed to a reverse conveyance path 32. The reverse conveyance path 32 changes a state of the sheet S passing through the reverse conveyance path 32 so that the back side of the sheet S on which the toner image is not formed faces the intermediate transfer belt 25, and the registration roller pair 26 conveys the sheet S to the secondary transfer roller 27. After the toner image is transferred and fixed to the back side of the sheet S, the output roller pair 30 ejects the sheet S on the output tray 31.

The image forming apparatus 1 includes a plurality of sheet detection sensors for detecting the presence of the sheet S inside the housing 2. In the present embodiment, the image forming apparatus 1 includes a sheet detection sensor 33*a* disposed downstream in a sheet conveyance direction from the feed roller 19 in the manual sheet feeding tray 18, a sheet detection sensor 33*b* disposed downstream in the sheet conveyance direction from a junction at which the sheets conveyed from the sheet feeding trays 13, 14, and 15 meet, and a sheet detection sensor 33*c* disposed upstream in the sheet conveyance direction from the registration roller pair 26. In addition, the image forming apparatus 1 includes a sheet detection sensor 33*d* disposed above the conveyance belt 29, a sheet detection sensor 33*e* disposed upstream in the sheet conveyance direction from the fixing device 28, a sheet detection sensor 33*f* disposed downstream in the sheet conveyance direction from the fixing device 28, and a sheet detection sensor 33*g* disposed upstream in the sheet conveyance direction from the output roller pair 30. Each sheet detection sensor 33*a*-33*g* sends detection results to the controller 23, and the controller 23 uses the detection results to specify a jam occurrence place when a sheet jam of the sheet S occurs in the housing 2.

The housing 2 includes a drawer 34 that is configured to be attachable to and detachable from the housing 2. The drawer 34 supports the registration roller pair 26, the secondary transfer roller 27, the fixing device 28, the output roller pair 30, the reverse conveyance path 32, and the like. Pulling out the drawer 34 from the housing 2 enables these parts to remove together from the housing 2. The housing 2 and the drawer 34 constitute an apparatus body 35.

Figure 2:
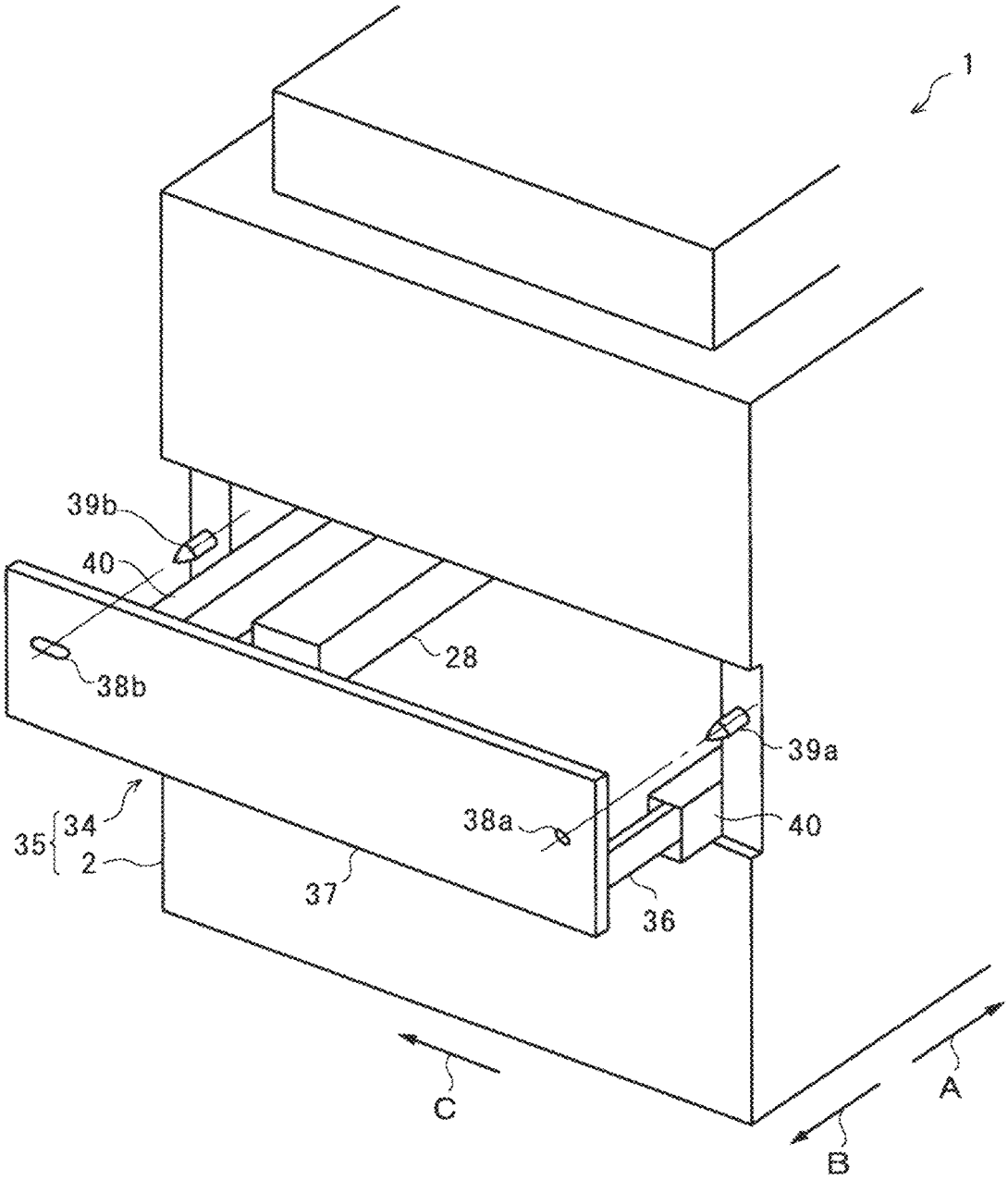
FIG. 2 is a schematic view of an apparatus body according to an embodiment of the present disclosure.

As illustrated in FIG. 2, moving (inserting) the drawer 34 in an insertion direction A from the front side of the image forming apparatus 1 in which the user stands toward the back side of the image forming apparatus 1 attaches the drawer 34 to the housing 2, and moving (pulling) the drawer 34 in a pulling direction B opposite to the insertion direction A detaches the drawer 34 from the housing 2. A sheet conveyance direction C of the sheet S moving in the drawer 34 is orthogonal to the insertion direction A and the pulling direction B.

The drawer 34 includes a main body 36 configured to hold parts such as the fixing device 28 described above and a front plate 37 attached to the front side of the main body 36. The front plate 37 has a main-fitting hole 38*a* and a sub-fitting hole 38*b* to position the drawer 34 in the housing 2 when the drawer 34 is set at a setting position in the housing 2. Positioning pins 39*a* and 39*b* are disposed in the housing 2 and fitted into the main-fitting hole 38*a* and the sub-fitting hole 38*b*, respectively.

The main-fitting hole 38*a* has a circular shape, and the sub-fitting hole 38*b* has an oval shape. The main-fitting hole 38*a* and the sub-fitting hole 38*b* are aligned in the sheet conveyance direction C of the sheet S and positioned at positions adjacent to both ends of the housing 2. The sub-fitting hole 38*b* has a dimension of the minor axis of the oval shape that is equal to the radius of the main-fitting hole 38*a* and a dimension of the major axis of the oval shape that is larger than the radius of the main-fitting hole 38*a*. The sub-fitting hole 38*b* extends in the sheet conveyance direction C of the sheet S. The above-described configuration of the main-fitting hole 38*a* and the sub-fitting hole 38*b* can reduce the inclination of the drawer 34 from the sheet conveyance direction C of the sheet S.

The positioning pins 39*a* and 39*b* are disposed in the vicinity of both ends of the front side of the housing 2 so as to be fitted into the main-fitting hole 38*a* and the sub-fitting hole 38*b*, respectively. The positioning pins 39*a* and 39*b* have pointed tips so as to be easily fitted into the main-fitting hole 38*a* and the sub-fitting hole 38*b*, respectively. The shapes of the main-fitting hole 38*a*, the sub-fitting hole 38*b*, and the positioning pins 39*a* and 39*b* is described later.

The housing 2 includes a pair of rails 40 supporting the main body 36 so as to be movable in the insertion direction A and the pulling direction B. In addition, the housing 2 includes the controller 23 and a power supply. The main body 36 includes a controller and cables that are electrically coupled to the controller 23 and the power supply in the housing 2. The controller 23 in the housing 2 controls the parts in the main body 36, and the power supply in the housing 2 supplies power to the parts in the main body 36.

The above-described configuration includes the drawer 34 having the main-fitting hole 38*a* and the sub-fitting hole 38*b* and the housing 2 having the positioning pins 39*a* and 39*b*, but a configuration of the present disclosure may include the drawer 34 having the positioning pins 39*a* and 39*b* and the housing 2 having the main-fitting hole 38*a* and the sub-fitting hole 38*b*.

Figure 3A:
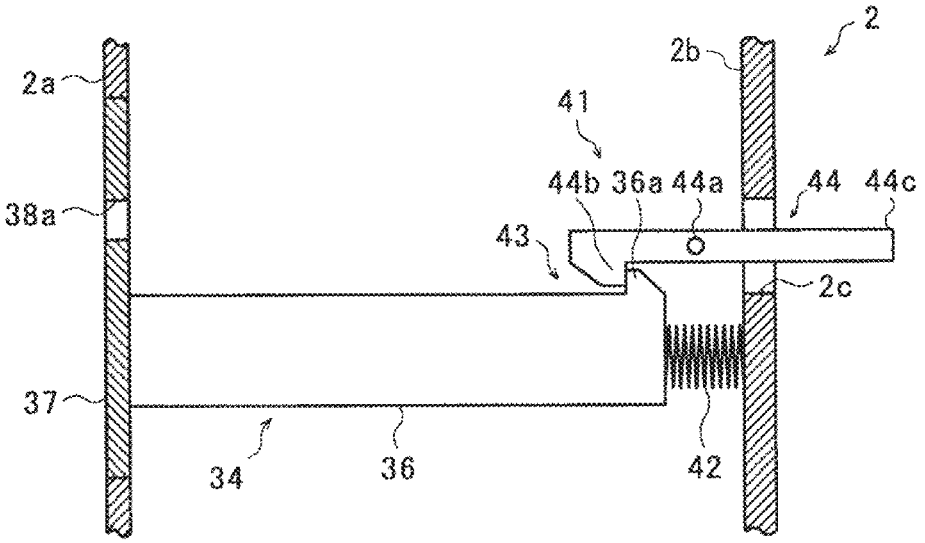
FIGS. 3A and 3B are schematic diagrams illustrating a configuration and operation of a push-out mechanism according to an embodiment of the present disclosure.
Figure 3B:
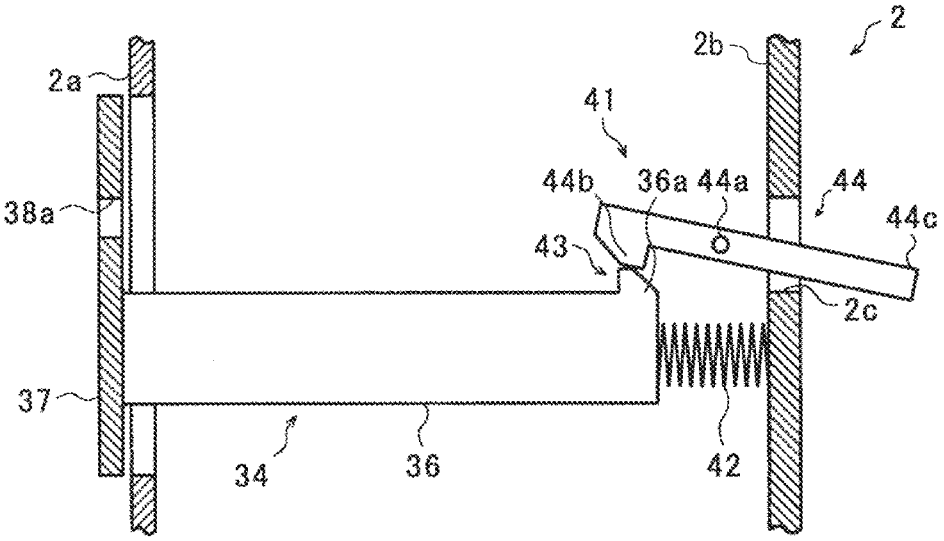

As illustrated in FIGS. 3A and 3B, a push-out mechanism 41 is disposed near a back plate 2*b* that faces a front plate 2*a* of the housing 2. The push-out mechanism 41 holds the drawer 34 at the setting position of the housing 2 and pushes out the drawer 34 by a predetermined amount from the setting position to assist the operation of pulling the drawer 34 out of the housing 2.

The push-out mechanism 41 includes a compression spring 42 as a biasing member and a holding mechanism 43 configured to hold the drawer 34 at the setting position.

The compression spring 42 has one end in contact with the back plate 2*b* and the other end in contact with the main body 36 and pushes the main body 36 toward the pulling direction B.

The holding mechanism 43 has a hook-shaped engaged portion 36*a* formed integrally with the main body 36 and a holding member 44 engageable to and disengageable from the engaged portion 36*a*. Side plates of the housing 2 rotatably support a support shaft 44*a* disposed at a center portion of the holding member 44. The holding member 44 includes a hook-shaped engaging portion 44*b* engageable with the engaged portion 36*a* on one end of the holding member 44. An other end 44*c* of the holding member 44 is out of the housing 2 through an opening hole 2*c* of the back plate 2*b* and is configured to be manually pushed downward, that is, manually operated. A torsion coil spring is set on the support shaft 44*a* and biases the holding member 44 to maintain the state illustrated in FIG. 3A.

FIG. 3A illustrates the drawer 34 set at the setting position, and in this state, the holding member 44 is at an engaging position in which the engaging portion 44*b* is engaged with the engaged portion 36*a*. Manually pushing the other end 44*c* of the holding member 44 downward displaces the holding member 44 to a non-engaging position at which an engaging state between the engaging portion 44*b* and the engaged portion 36*a* is released, and the compression spring 42 pushes the main body 36 in the pulling direction B. As a result, the main body 36 is pushed out from the setting position by a predetermined amount as illustrated in FIG. 3B, which is referred to as a setting released state.

Next, the following describes shapes of the main-fitting hole 38*a*, the sub-fitting hole 38*b*, and the positioning pins 39*a* and 39*b*. Prior to the description of the configuration of the present embodiment, the following describes shapes of fitting holes 50 and positioning pins 51 that are fitted into the fitting holes 50 according to a comparative embodiment with reference to FIGS. 4A and 4B.

The fitting holes 50 are disposed near both ends of a front plate 52 of a drawer of the comparative embodiment. One of the fitting holes 50 has a circular shape, and the other fitting hole 50 has an oval shape.

The positioning pins 51 are disposed near both ends of a housing of the comparative embodiment so as to be fitted into the fitting holes 50, respectively.

Figure 4A:
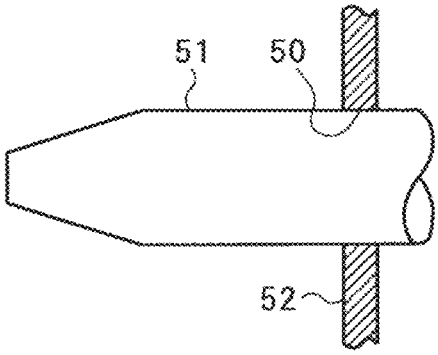
FIGS. 4A and 4B are schematic views of a positioner according to a comparative embodiment.

When the drawer is inserted into the housing to set the drawer at the setting position, the positioning pins 51 are fitted to the fitting holes 50 as illustrated in FIG. 4A. In this state, the straight portions of the positioning pins 51 are firmly fitted into the respective fitting holes 50 to firmly position the drawer with respect to the housing.

Figure 4B:
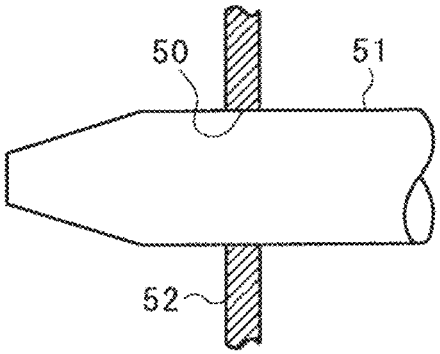

Subsequently, a push-out mechanism similar to the push-out mechanism according to the present embodiment works and pushes out the drawer by a predetermined amount, and the front plate 52 relatively moves leftward with respect to the positioning pin 51 as illustrated in FIG. 4B. Even in this state, the straight portion of the positioning pin 51 is firmly fitted into the fitting hole 50. Therefore, when the drawer is pulled out after the push-out mechanism moves the drawer in the pulling direction B by the predetermined amount, a frictional force proportional to the weight of the drawer occurs between the fitting hole 50 and the straight portion of the positioning pin 51. Pulling the drawer out of the housing when the frictional force occurs in the comparative embodiment needs a large operational force.

Figure 5A:
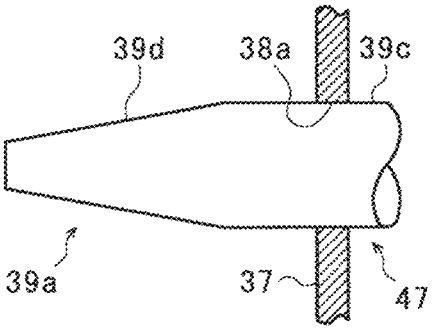
FIGS. 5A and 5B are schematic views of a positioner according to an embodiment of the present disclosure.
Figure 5B:
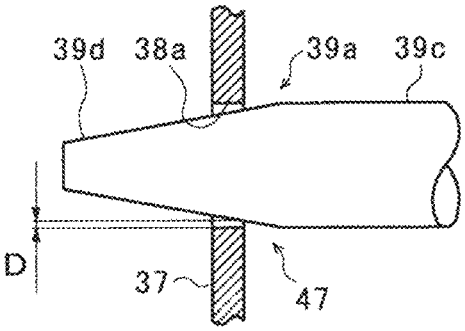

The following describes a configuration according to the present embodiment that reduces the operational force. FIGS. 5A and 5B are schematic views illustrating a positioner 47 according to the embodiment of the present disclosure. In FIGS. 5A and 5B, the positioner 47 includes the main-fitting hole 38*a*, the sub-fitting hole 38*b*, and the positioning pins 39*a* and 39*b*. Each of the positioning pins 39*a* and 39*b* in the present embodiment has a tapered to portion 39*d* at a tip end portion of each of the positioning pins 39*a* and 39*b*, and the tapered portion 39 in the present embodiment is longer than the tapered portion of each of the positioning pins 51 in the comparative embodiment.

When the drawer 34 is inserted into the housing 2 to set the drawer 34 at the setting position, the positioning pins 39*a* and 39*b* are fitted to the main-fitting hole 38*a* and the sub-fitting hole 38*b*, respectively, as illustrated in FIG. 5A.

In this state, a straight portions 39*c* of the positioning pins 39*a* and 39*b* are firmly fitted into the main-fitting hole 38*a* and the sub-fitting hole 38*b*, respectively, and the positioner 47 firmly positions the drawer 34 with respect to the housing 2. FIG. 5A illustrates the positioning pin 39*a* and the main-fitting hole 38*a*, but the state of the positioning pin 39*b* is the same as the state of the positioning pin 39*a*.

Subsequently, the push-out mechanism 41 according to the present embodiment works and pushes out the drawer 34 by the predetermined amount, and the front plate 37 relatively moves leftward with respect to the positioning pins 39*a* and 39*b* as illustrated in FIG. 5B that illustrates the positioning pin 39*a* and the main-fitting hole 38*a*, but the state of the positioning pin 39*b* is the same as the state of the positioning pin 39*a*. In this state, the straight portions 39*c* of the positioning pins 39*a* and 39*b* are disengaged from the main-fitting hole 38*a* and the sub-fitting hole 38*b*, respectively. The tapered portions 39*d* at the tip end portions of the positioning pins 39*a* and 39*b* are in the main-fitting hole 38*a* and the sub-fitting hole 38*b*, respectively. FIG. 5A illustrates the positioning pin 39*a* and the main-fitting hole 38*a*, but the state of the positioning pin 39*b* is the same as the state of the positioning pin 39*a*. The above-described configuration having longer tapered portions 39*d* than the configuration of the comparative embodiment generates a clearance D between the positioning pin 39*a* and the main-fitting hole 38*a* and between the positioning pin 39*b* and the sub-fitting hole 38*b* when the drawer 34 is pulled out after the push-out mechanism 41 moves the drawer 34 by the predetermined amount in the pulling direction B.

In the above-described configuration according to the present disclosure, when the push-out mechanism 41 works and pushes out the drawer 34 by the predetermined amount to displace the drawer 34 from the setting position to a position of the setting release state, the positioning pins 39*a* and 39*b* fitted in the main-fitting holes 38*a* and the sub-fitting hole 38*b* are displaced relative to the main-fitting hole 38*a* and the sub-fitting hole 38*b*, respectively. As a result, fitting the straight portion 39*c* of the positioning pin 39*a* to the main-fitting hole 38*a* is released, and the tapered portion 39*d* of the positioning pin 39*a* is in the main-fitting hole 38*a*. Similarly, fitting the straight portion 39*c* of the positioning pin 39*b* to the sub-fitting hole 38*b* is released, and the tapered portion 39*d* of the positioning pin 39*b* is in the sub-fitting hole 38*b*. Since the above-described configuration forms the clearance D between the main-fitting hole 38*a* and the tapered portion 39*d* and between the sub-fitting hole 38*b* and the tapered portion 39*d*, the weight of the drawer 34 does not act on the main-fitting hole 38*a* and the sub-fitting hole 38*b* of the drawer 34 after the push-out mechanism pushes the drawer 34 out of the housing 2 from the setting position by the predetermined amount in the pulling direction B. Accordingly, the present embodiment can provide the apparatus body 35 that can reduce the operational force to pull the drawer 34.

Next, a variation of the above-described embodiment is described with reference to FIGS. 6A and 6B.

Figure 6A:
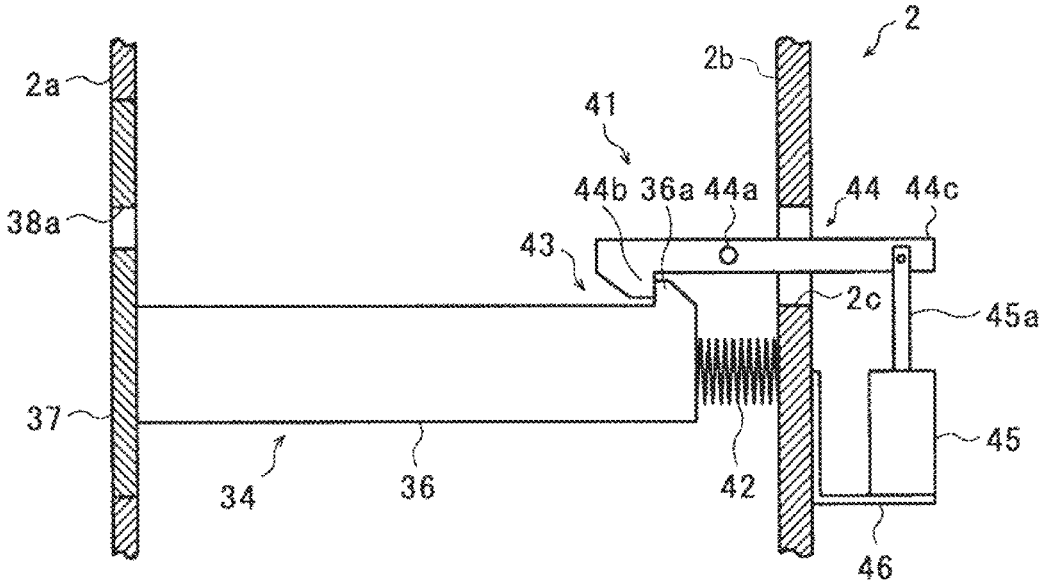
FIGS. 6A and 6B are schematic diagrams illustrating a configuration and operation of a variation of the push-out mechanism of FIGS. 3A and 3B.
Figure 6B:
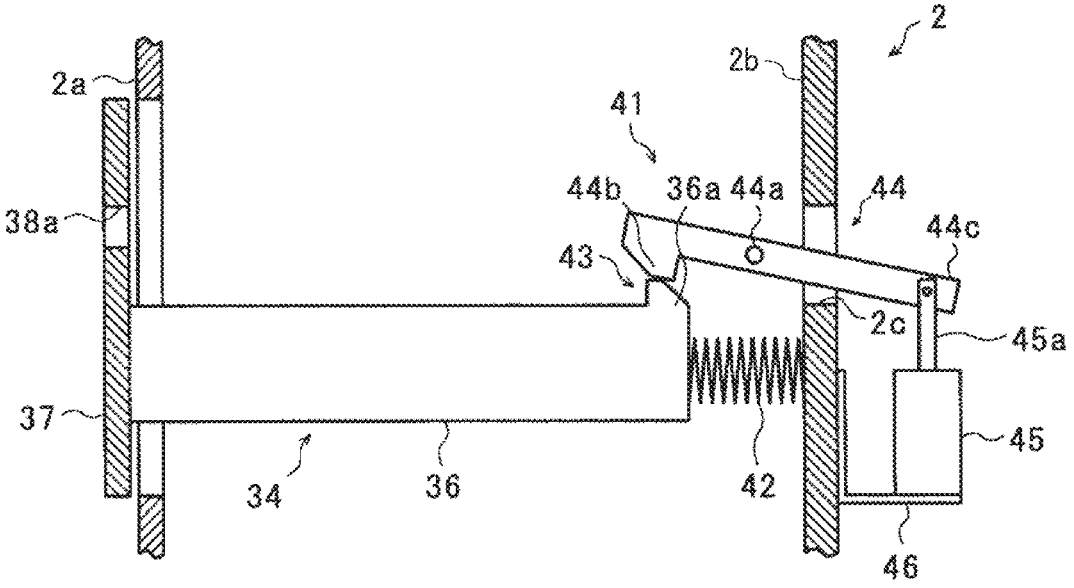

The variation illustrated in FIGS. 6A and 6B is different from the above-described embodiment illustrated in FIGS. 3A and 3B in that a solenoid 45 as a driver drives the holding member 44, and other configurations are the same.

The solenoid 45 is fixed to the outside of the back plate 2*b* by a bracket 46, and the tip of a plunger 45*a* of the solenoid 45 is attached to the other end 44*c* of the holding member 44. The controller 23 controls operations of the solenoid 45. When the plunger 45*a* is at a first position illustrated in FIG. 6A, the holding member 44 is at the engaging position. When the plunger 45*a* is at a second position illustrated in FIG. 6B, the holding member 44 is at the non-engaging position.

The above-described configuration can automatically move the holding member 44 and easily pull the drawer 34 out of the housing 2.

In the above-described embodiment and variation, the image forming apparatus 1 is a multifunction peripheral having a printer function and a copier function that can form the full-color toner image, but the image forming apparatus is not limited thereto. The present disclosure is adoptable to a printer, a facsimile machine, and a copier. In the above-described embodiment and variation, the sheet S is mentioned as an example of the recording medium on which an image is formed, and is not limited to the standard paper but also includes thick paper, a postcard, an envelope, plain paper, thin paper, coated paper, art paper, tracing paper, an overhead projector transparency (OHP sheet or OHP film), a resin film, and any other sheet-shaped material on which an image can be formed.

The above-described embodiment is illustrative and does not limit the present disclosure. Thus, numerous additional modifications and variations are possible in light of the above teachings. For example, elements and/or features of the embodiment and variation may be combined with each other and/or substituted for each other within the scope of the present disclosure. The advantages achieved by the embodiment described above are examples and therefore are not limited to those described above.

The embodiments of the present disclosure have been described in detail above. The above-described embodiments are examples and can be modified within the scope not departing from the gist of the present disclosure. For example, any embodiment and any modification may be combined.

Numerous additional modifications and variations are possible in light of the above teachings. It is therefore to be understood that within the scope of the appended claims, the present disclosure may be practiced otherwise than as specifically described herein. The number, position, and shape of the components of the image forming apparatus described above are not limited to those described above.

What is claimed is:

1. An apparatus body comprising:

a housing;

a drawer configured to be attachable to and detachable from the housing;

a push-out mechanism configured to push out the drawer by a predetermined amount from a setting position at which the drawer is positioned in the housing; and a positioner configured to position the drawer at the setting position in the housing, the positioner including:

a fitting hole disposed in one of the housing and the drawer, and a positioning pin disposed in the other of the housing and the drawer and configured to position the drawer at the setting position in the housing in response to fitting of the positioning pin into the fitting hole, the positioning pin and the fitting hole each having a form that releases the fitting in response to pushing out of the drawer by the predetermined amount from the setting position.

2. The apparatus body according to claim 1, wherein the push-out mechanism includes:

a biasing member that biases the drawer in a direction in which the push-out mechanism pushes the drawer; and a holding mechanism configured to hold the drawer at the setting position.

3. The apparatus body according to claim 2, wherein the holding mechanism includes a holding member configured to be engageable to and disengageable from the drawer.

4. The apparatus body according to claim 3, wherein the holding member is configured to be manually operated.

5. The apparatus body according to claim 3, further comprising:

a driver configured to drive the holding member; and a controller configured to control the driver.

6. An image forming apparatus comprising the apparatus body according to claim 1.

* * * * *